US006367496B1

(12) United States Patent
Rempel et al.

(10) Patent No.: US 6,367,496 B1
(45) Date of Patent: Apr. 9, 2002

(54) DRIVING RANGE SHELTER

(75) Inventors: Bruce W. Rempel; Richard Johnson; Benjamin Libby; Allan Fulton, all of Saskatoon (CA)

(73) Assignee: Dryrainge Equipment Company Inc., Saskatoon (CA)

( * ) Notice: Subject to any disclaimer, the term of this patent is extended or adjusted under 35 U.S.C. 154(b) by 0 days.

(21) Appl. No.: 09/664,221

(22) Filed: Sep. 18, 2000

(51) Int. Cl.[7] ..... E04H 15/34

(52) U.S. Cl. ..... 135/122; 135/123; 135/124; 135/93; 135/906; 135/913; 52/222; 52/86

(58) Field of Search ..... 135/906, 913, 135/122, 123, 124, 93; 52/86, 63, 222

(56) References Cited

U.S. PATENT DOCUMENTS 1,124,263 A * 1/1915 Bemis ..... 135/913 X
2,513,729 A * 7/1950 Lemen ..... 135/222
2,693,195 A * 11/1954 Frieder et al. ..... 135/906 X
2,764,107 A * 9/1956 Niswonger et al. ..... 135/122 X
2,828,756 A * 4/1958 Worley ..... 135/122 X
2,856,941 A * 10/1958 O'Neal ..... 135/906 X
3,028,872 A * 4/1962 Cresswell ..... 135/122 X
3,256,896 A * 6/1966 Cummins ..... 135/906 X
3,441,037 A * 4/1969 Transeau ..... 135/906 X
3,846,943 A * 11/1974 Wagner ..... 135/906 X
3,868,155 A * 2/1975 Cherubini ..... 135/906 X
3,897,622 A * 8/1975 Utahara ..... 52/86
3,925,942 A * 12/1975 Hemmelsbach ..... 135/122 X
4,052,834 A * 10/1977 Ellen ..... 52/222 X
5,011,152 A 4/1991 Hugunin
5,295,335 A * 3/1994 Collier ..... 52/86
5,333,421 A * 8/1994 McKenna ..... 52/86
5,575,301 A 11/1996 Bolton
5,967,162 A 10/1999 Bolton
6,155,280 A * 12/2000 Powell et al. ..... 135/906 X

OTHER PUBLICATIONS

Fiesta Tents Ltd. Solar System Clearspans www.fiesta.ca/ranges.htm Nov. 27, 1998.

* cited by examiner

*Primary Examiner*—Robert Canfield
(74) *Attorney, Agent, or Firm*—Murray E. Thrift

(57) ABSTRACT

A portable shelter includes a frame having front and back arches joined by two skids at their bottom ends and a set of braces extending between the arches. A cover over the frame has a water impervious top panel and end and back panels that are an air pervious mesh. The shelter is particularly useful in sporting installations, for example golf driving ranges.

4 Claims, 9 Drawing Sheets

DRIVING RANGE SHELTER

FIELD OF THE INVENTION

The present invention relates to portable shelters, and more particularly to portable shelters of the type providing overhead protection from sun and rain.

BACKGROUND

Portable rain and sun shelters have various applications. Of particular interest with the present invention is the use of a shelter at a sports installation, for example a golf driving range, where one or more sheltered participants may make use of the installation to provide a degree of comfort in times of excessive sun, rain or other inclement weather. The invention is not however, limited to this application and may be used wherever a portable or temporary overhead shelter is desirable.

One proposal for a mobile shelter is disclosed in U.S. Pat. No. 5,967,162 issued Oct. 19, 1999 to Mark Alan Bolton. The shelter disclosed in that patent has an overhead canopy mounted on two wheeled end frames. The canopy is arched from front to back and supported on a center beam truss extending between the two end frames. This is a relatively heavy structure that provides shelter for the users from directly overhead. The relatively massive end frames are useful in holding the shelter down against wind induced lift forces on the airfoil shaped canopy.

The present invention addresses various novel characteristics in an overhead shelter.

SUMMARY

According to the present invention there is provided a portable shelter comprising:

a frame including:

spaced apart front and back arches;

two ground support skids joining the arches along opposite ends of the frame for supporting the frame on a ground surface for sliding movement thereon;

a cover including:

a substantially water impervious top panel extending between the front and back arches, over a center section of the frame, with ends of the top panel spaced above the respective skids; and two end panels of air pervious mesh extending from the respective ends of the top panel towards the respective skids.

This frame may be constructed of relatively lightweight tubing, making the shelter easily moveable. At the same time, it is found that the shelter can be held down even in high wind conditions using simple ground anchors, for example pins or pegs. The air pervious end panels limit the wind loads on the shelter, while still providing a reduction in the wind and sun passing through the panels.

The shelter may include a back panel. This preferably includes a top portion that is an integral extension of the top panel of the cover, wrapped over the back arch. A lower portion of the back panel is an air pervious mesh. This provides still further shelter to the users while ensuring that the wind loads on the structure are within acceptable limits.

BRIEF DESCRIPTION OF THE DRAWINGS

In the accompanying drawings, which illustrate an exemplary embodiment of the present invention.

DETAILED DESCRIPTION

Referring to the accompanying drawings, there is illustrated a shelter 10 having a front side 12 and a back side 14, and two opposite ends 16 and 18.

Figure 9:
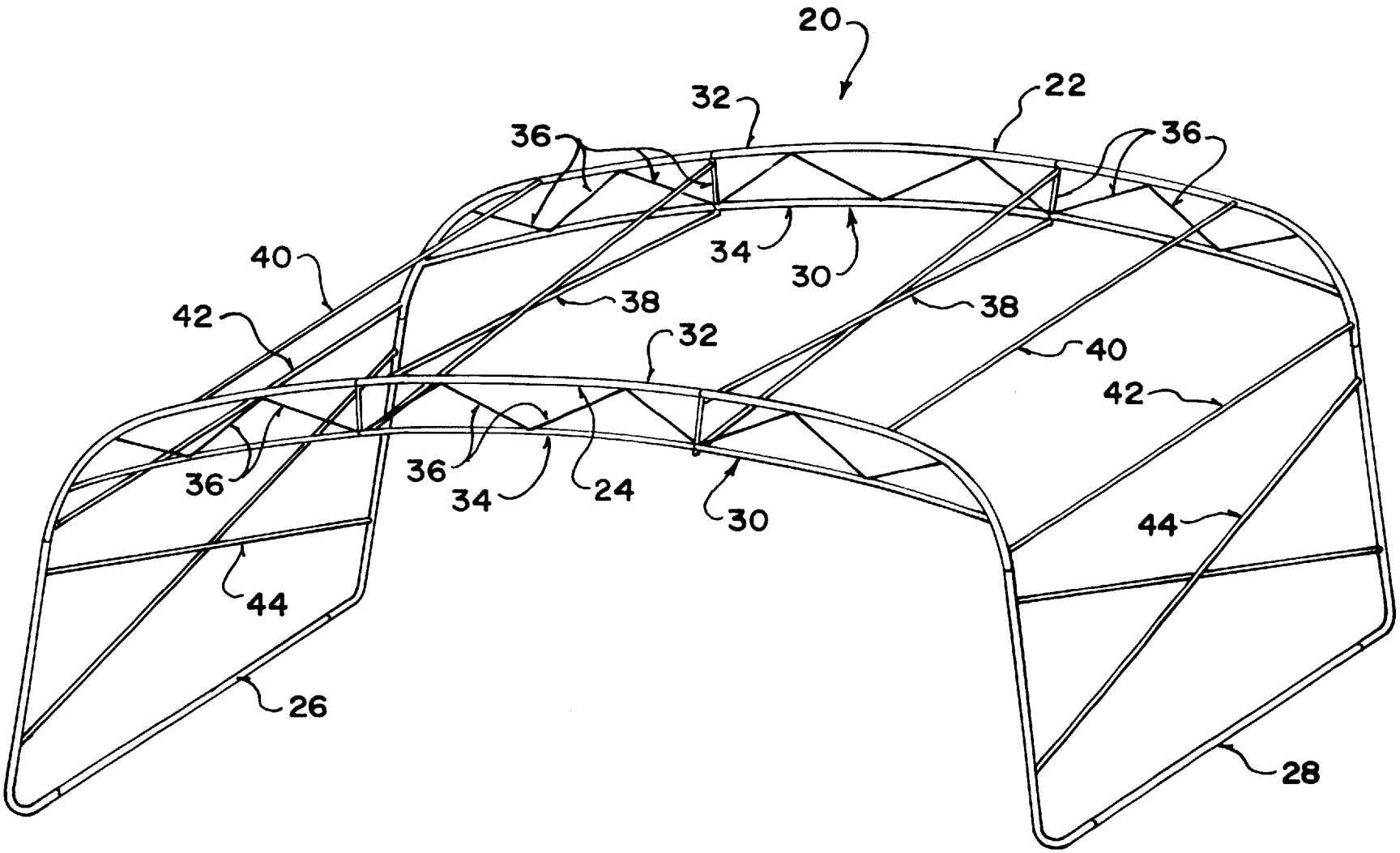
FIG. 9 is an perspective view of the frame without the cover.

The shelter includes a frame 20 that is illustrated most particularly in FIG. 9. The frame includes a front arch 22 and a back arch 24 at the respective front and back sides of the shelter. The front and back arches are joined at the ends of the shelter by skids 26 and 28 respectively. The arches and the skids are made from lightweight tubular metal elements to provide a lightweight, rigid structure. The opposite ends of the skids 26 and 28 are turned upwardly to meet the bottom ends of the arches so that the skids may slide readily over a ground surface.

The top, center section of each arch is a truss structure 30. The main tube of the arch forms the upper chord 32 of this truss. A lower chord 34 is spaced below the upper chord and joins it adjacent the opposite ends. A series of struts 36 join the two chords.

At the top of the frame, the two trusses are joined by two X-shaped braces 38. Each brace has two members, which extend from the upper chords of respective ones of the trusses to the lower chords of the other trusses. The upper chords are also joined by two straight braces 40. At the ends of the frame, the arches are joined by straight braces 42 and by X braces 44.

The frame 20 supports a cover 46. This includes a top panel 48 that extends from end to end over the top of the two arches and two end panels 50 that extend from the respective ends of the top panel down the respective frame ends. A back panel 52 extends downwardly across the back side of the shelter from the top panel 48. This includes an upper portion 54 extending from the bottom end of each end panel, up the end of the frame and across the back of the frame at the top. This upper portion is an integral extension of the top panel 48. A lower portion 56 of the back panel extends downwardly from the upper portion from end to end of the shelter. It has a concave bottom edge 57. A short front panel 58 is also an integral extension of the top panel that extends down across the front of the shelter. At the ends of the shelter, the end panels 50 wrap around the front arch to form end portions of the front panel 58.

The top panel 48, the upper portion 54 of the back panel and the front panel 58 are all of water impervious flaccid material. The end panels 50 and the lower portion 56 of the back panel are all formed from an air pervious mesh material.

Figure 1:
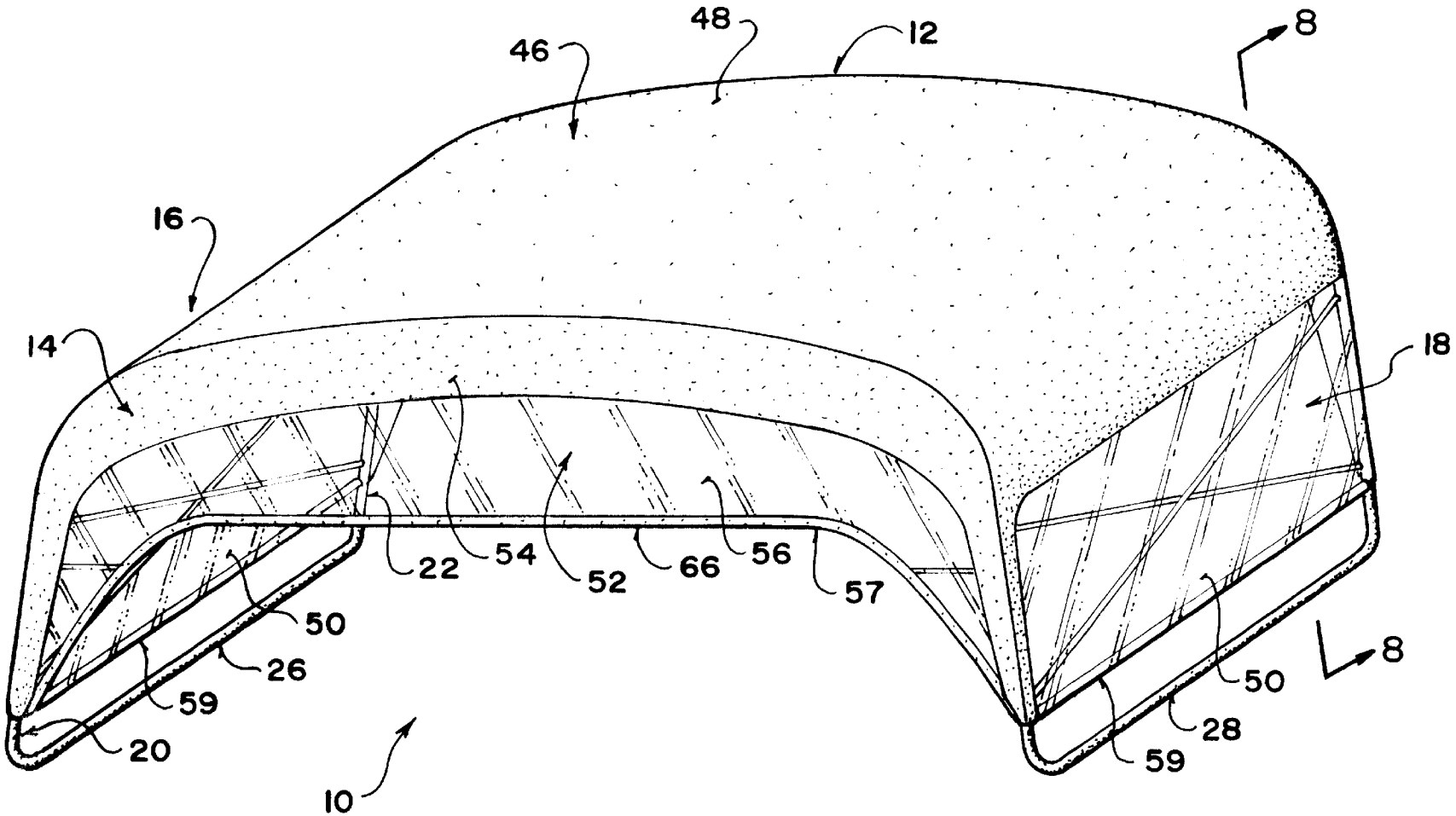
FIG. 1 is an isometric view of a shelter from the back and one end.
Figure 2:
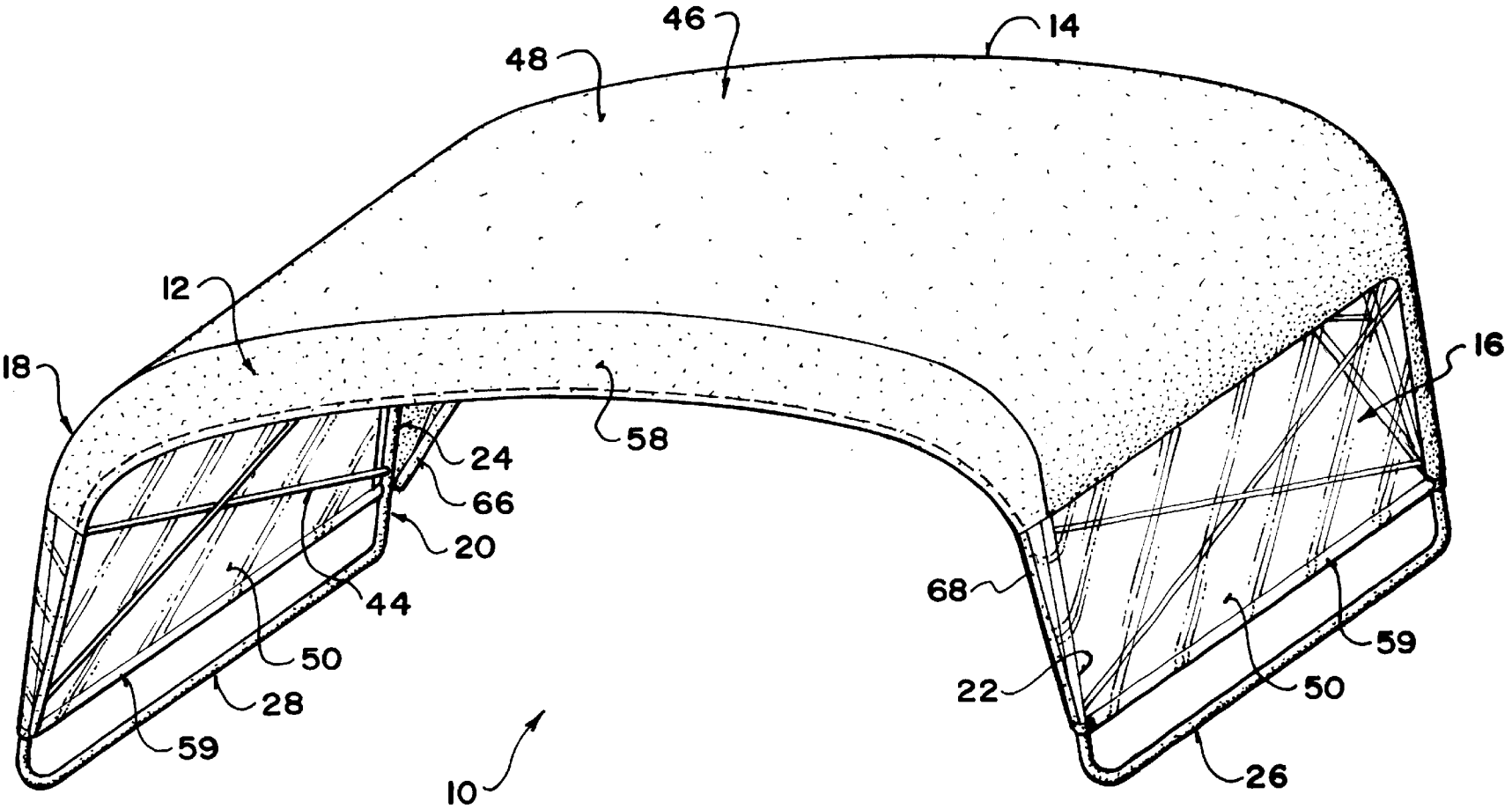
FIG. 2 is an isometric view of the shelter from the front side and the opposite end.
Figure 3:
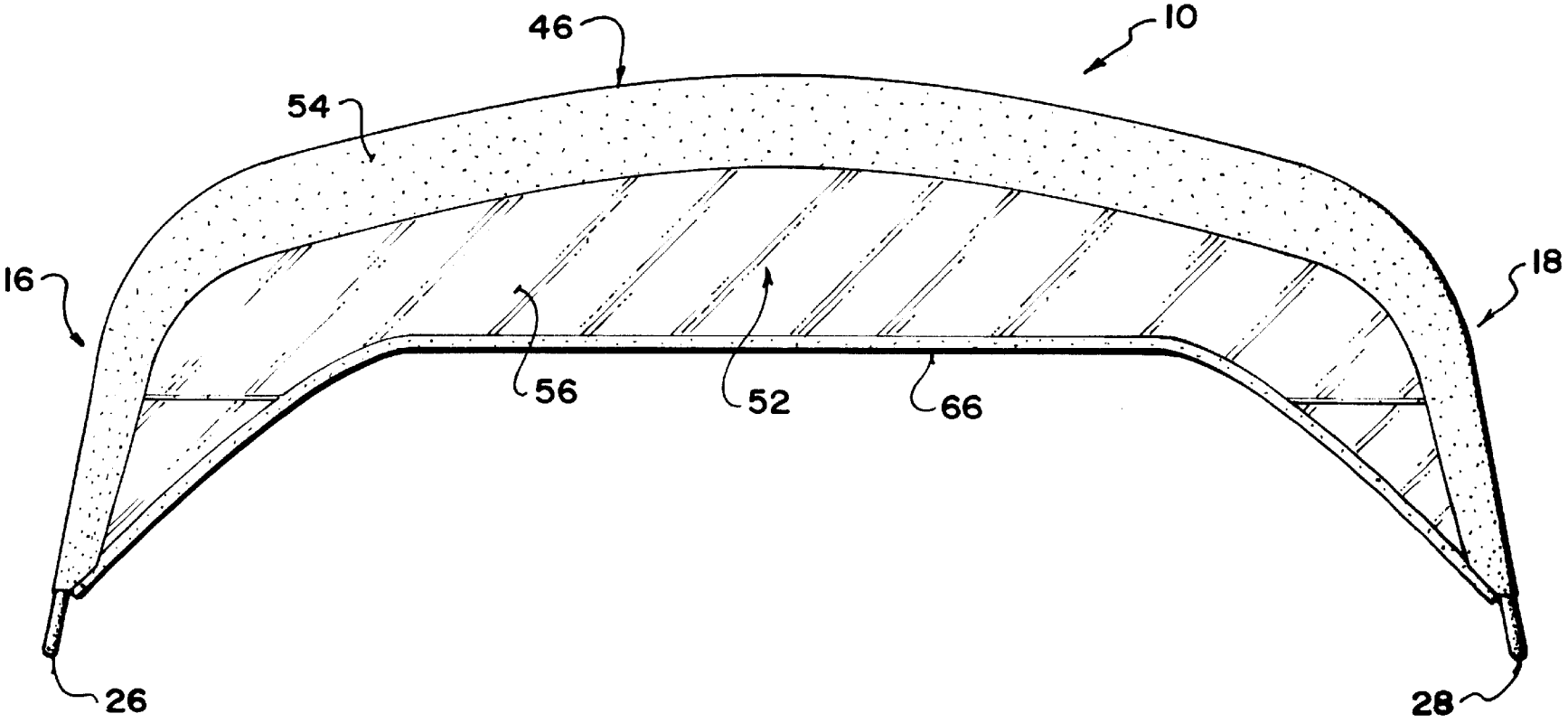
FIG. 3 is a back elevation of the shelter.
Figure 4:
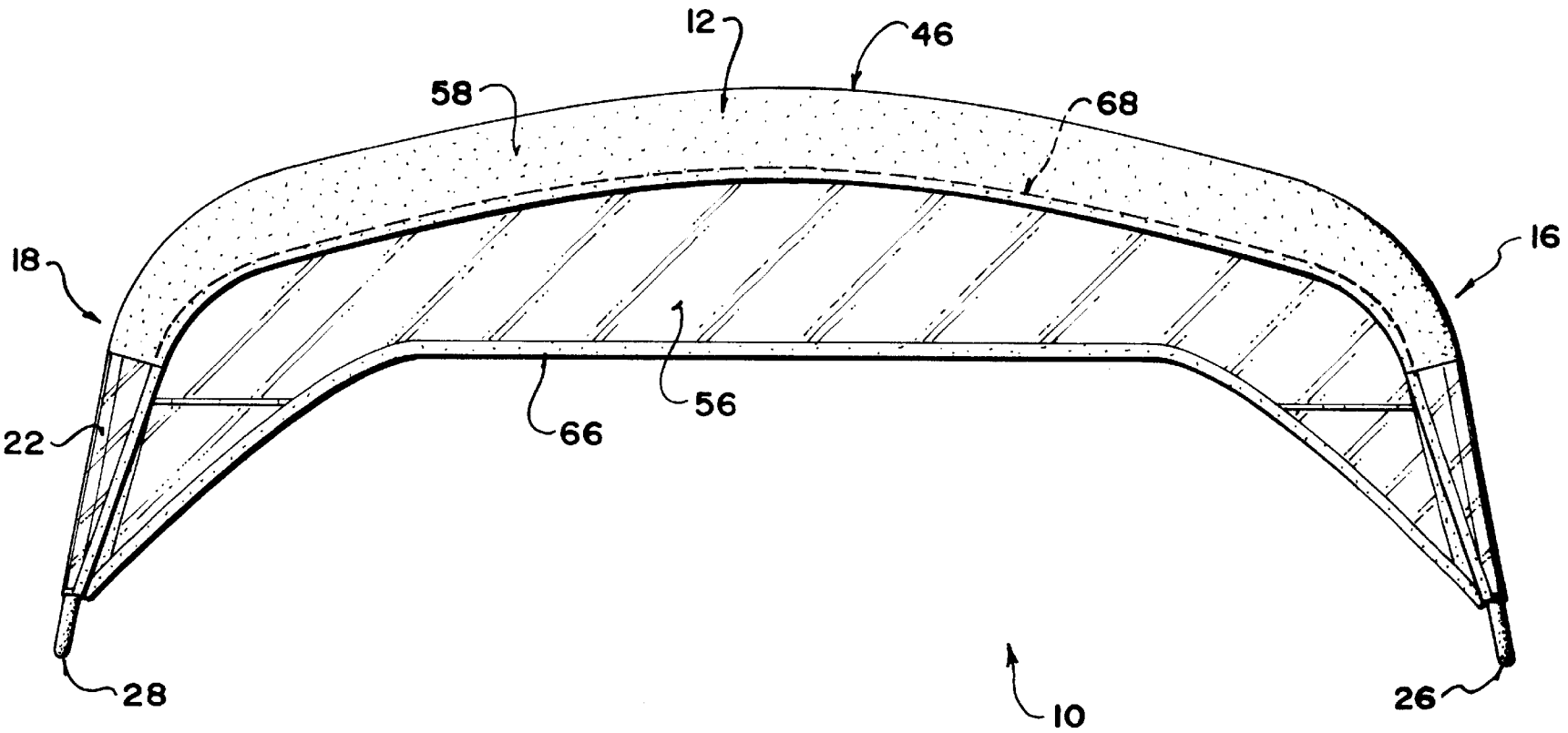
FIG. 4 is a front elevation of the shelter.
Figure 5:
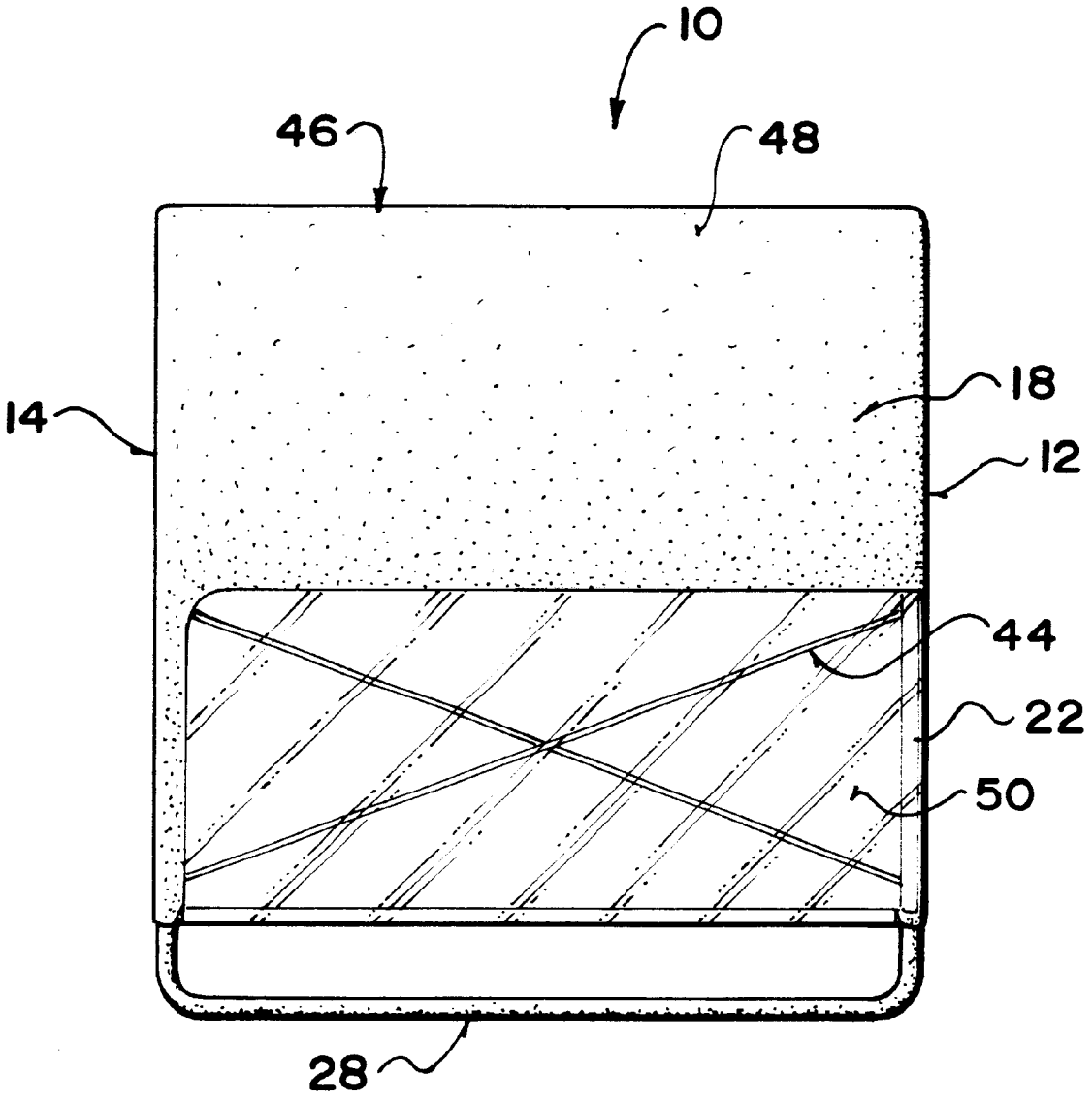
FIG. 5 is an end elevation of the shelter, the opposite end being the mirror image.
Figure 6:
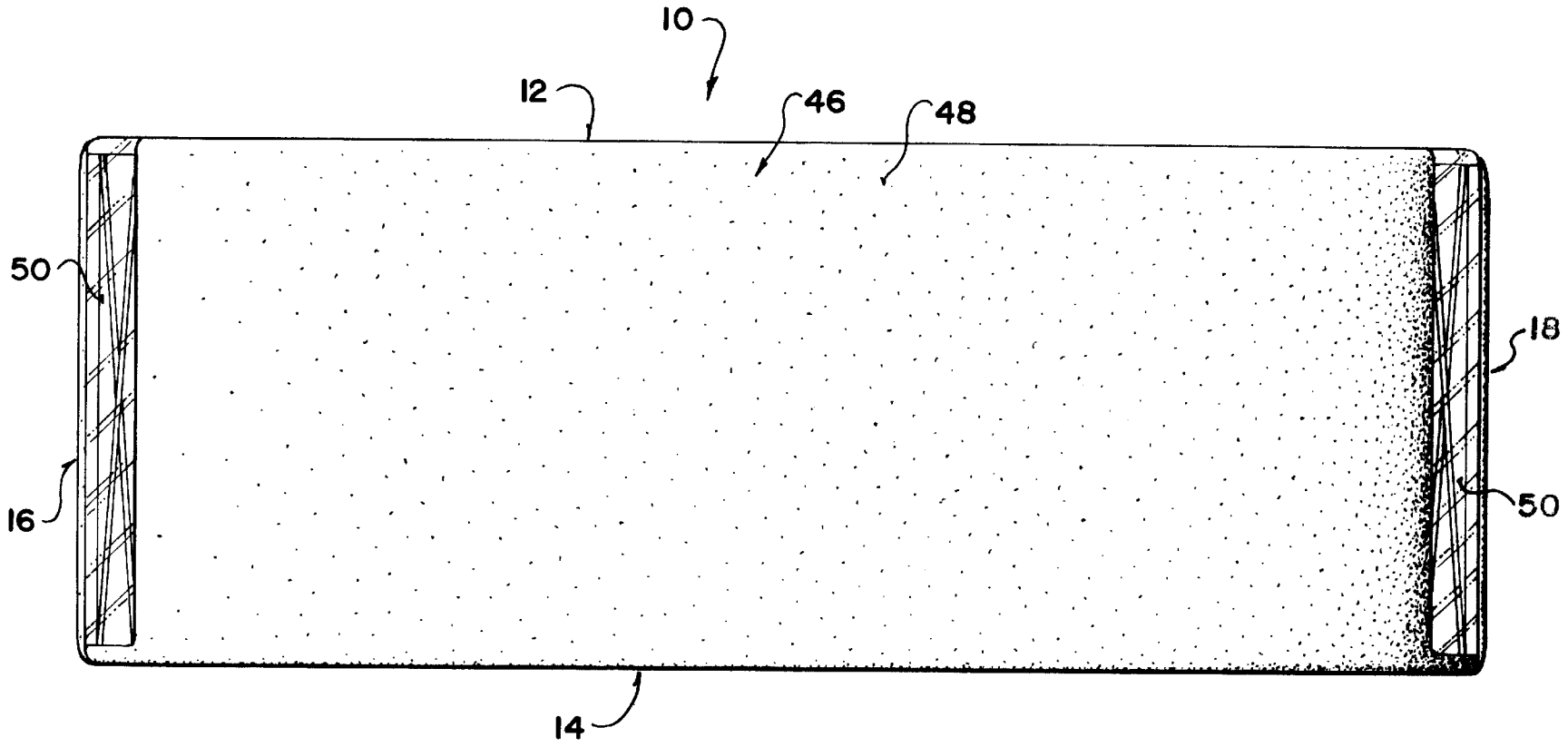
FIG. 6 is a plan view of the shelter.
Figure 7:
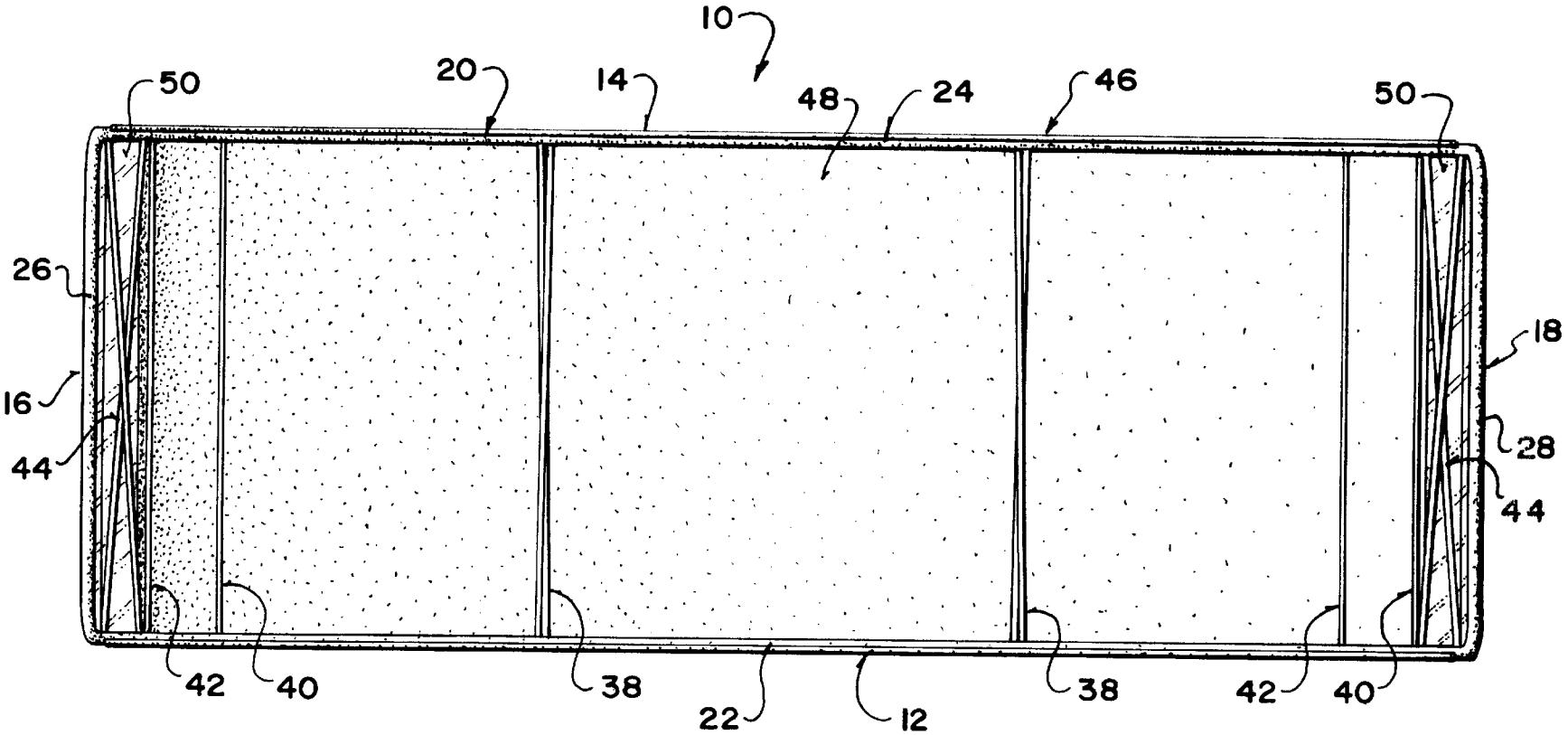
FIG. 7 is a bottom view of the shelter.
Figure 8:
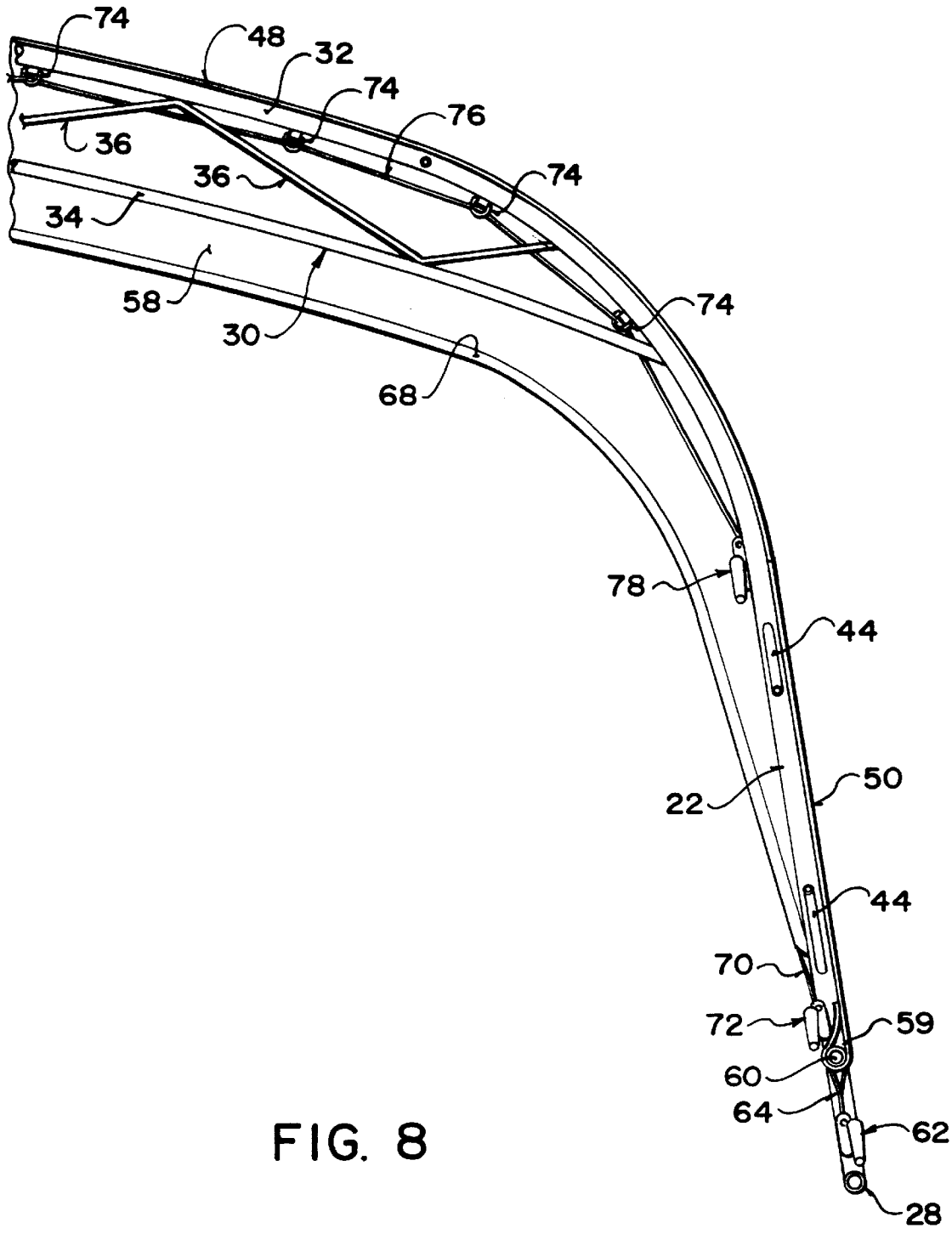
FIG. 8 is a cross-section along line 8—8 of FIG. 1 showing the hold-down ratchets for the cover.

Along the bottom edge of each end panel 50 is a sleeve 59 that carries a cross pipe 60 (FIG. 8). To tension the end panels of the cover, two ratchet type tensioners 62 are mounted on each skid 26 and 28, as shown most particularly in FIG. 8. The tensioner 62 is a known commercial device for tensioning belts, for example, a device such as that disclosed in U.S. Pat. No. 4,199,182 issued Apr. 22, 1980 to Sigvard B. Sunesson and assigned to Goteborgs Bandvaveri AB. Each tensioner carries a webbing strap 64 that is wrapped around a respective end of the cross pipe 60 to draw the pipe down towards the skid.

Along the bottom edge of the back panel 52 is a sleeve 66. A similar sleeve 68 extends along the bottom edge of the front panel 58. Webbing straps 70 extend through of the sleeves 66 and 68. One of these straps is shown in FIG. 8. Each strap is connected at its opposite ends to ratchet tensioners 72 mounted on the ends of the frame 20. These intermediate level ratchet tensioners are of the same configuration as the tensioner 62. In use, they maintain the front and back panels in a stretched condition between the arches 22 and 24 and the bottom edges of the panels.

Two sets of D-rings 74 are mounted on the top panel just outside the front and rear arches 72 and 74 respectively. They extend along the trussed upper sections of the two arches. A webbing strap 76 extends through each set of D-rings and is connected at its opposite ends to two tensioners 78 mounted on the adjacent arch near the top of the end panels. This arrangement is used to tighten the top panel from front to back.

While FIG. 8 illustrates the tensioning arrangement at one front corner of the shelter, it is to be understood that a similar arrangement is used at each corner, both front and back. This provides a total of twelve ratchets, three at each corner. The set of twelve ratchets and the associated webbing straps serve to tension the cover and to keep it taut on the frame. They also allow for the easy installation and removal of the cover on the frame so that installation or removal becomes a relatively simple process.

The shelter is relatively lightweight and can easily be moved by one or two persons, depending on the size of the shelter, so that when it is not needed it can be placed aside and vice versa. It can readily be moved from place to place on a natural grass surface, eliminating any permanent shading of a particular patch of the surface. The shelter provides not only overhead protection from sun and rain but also some protection from the sides and back from sun and wind conditions. At the same time, the air permeable end and back panels limit the amount of wind loading on the shelter so that it is relatively easy to hold down even in high wind conditions.

While the shelter has been described in the foregoing as being particularly applicable to sporting installations, for example driving ranges, it is to be understood that shelters of this type may also be used for any other application where an overhead shelter may be useful, for example lawn parties and outdoor concerts. Thus, while one exemplary embodiment of the present invention has been described in the forgoing, it is to be understood that other embodiments are possible within the scope of the invention and are intended to be included herein. The invention is to be considered limited solely by the scope of the appended claims.

What is claimed is:

1. A portable shelter comprising:

a frame including:

spaced apart front and back arches, each including a trussed center section and two downwardly divergent end sections depending from opposite ends of the center section;

two ground support skids joining the arches along opposite ends of the frame for supporting the frame on a ground surface for sliding movement thereon, each skid comprising an elongate tubular member with opposite ends turned upwardly and meeting bottom ends of the respective arches whereby the skids may slide readily over a ground surface;

a substantially flaccid cover including:

a substantially water impervious top panel extending between the front and back arches, over a center section of the frame, with ends of the top panel spaced above the respective skids;

two end panels of air pervious mesh extending from the respective ends of the top panel part way towards the respective skids such that each end panel has a bottom edge spaced above the respective skid; and cover tensioning means for tensioning the cover between the opposite ends of the frame.

2. A shelter according to claim 1 wherein the cover includes a back panel extending from the back arch partially across a back side of the frame.

3. A shelter according to claim 2 wherein the back panel includes an upper portion comprising an integral extension of the top panel and a lower portion of air pervious mesh.

4. A shelter according to claim 1 wherein the frame includes a plurality of cross members extending between the front and back arches.

* * * * *